US010302097B2

(12) United States Patent
Jiang et al.

(10) Patent No.: US 10,302,097 B2
(45) Date of Patent: May 28, 2019

(54) CENTRIFUGAL COMPRESSOR AND CENTRIFUGAL WATER CHILLING UNIT

(71) Applicant: Gree Electric Appliances, Inc. of ZHUHAI, Zhuhai, Guangdong (CN)

(72) Inventors: Nan Jiang, Zhuhai (CN); Ruixing Zhong, Zhuhai (CN); Caiyun Jiang, Zhuhai (CN); Rong Xie, Zhuhai (CN); Hongxing Wang, Zhuhai (CN); Jianfei Liu, Zhuhai (CN); Yuhui Chen, Zhuhai (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 467 days.

(21) Appl. No.: 15/037,359

(22) PCT Filed: Jul. 22, 2014

(86) PCT No.: PCT/CN2014/082751
§ 371 (c)(1),
(2) Date: May 18, 2016

(87) PCT Pub. No.: WO2015/070637
PCT Pub. Date: May 21, 2015

(65) Prior Publication Data

US 2016/0281735 A1 Sep. 29, 2016

(30) Foreign Application Priority Data

Nov. 18, 2013 (CN) ..... 2013 1 0578246

(51) Int. Cl.
*F04D 29/46* (2006.01)
*F04D 29/28* (2006.01)
*F04D 29/42* (2006.01)

(52) U.S. Cl.
CPC ..... *F04D 29/462* (2013.01); *F04D 29/284* (2013.01); *F04D 29/4206* (2013.01);
(Continued)

(58) Field of Classification Search
CPC .. F04D 29/462; F04D 29/284; F04D 29/4206; F04D 29/4213; F04D 29/464;
(Continued)

(56) References Cited

U.S. PATENT DOCUMENTS 3,362,624 A * 1/1968 Endress ..... F04D 27/0215 415/1
3,362,625 A 1/1968 Endress
(Continued)

FOREIGN PATENT DOCUMENTS

CN 2536821 Y 2/2003
CN 201330717 Y 10/2009
(Continued)

OTHER PUBLICATIONS

WIPO, International Search Report dated Nov. 4, 2014.
(Continued)

*Primary Examiner* — David E Sosnowski
*Assistant Examiner* — Eric J Zamora Alvarez
(74) *Attorney, Agent, or Firm* — Li & Cai Intellectual Property (USA) Office

(57) ABSTRACT

The invention discloses a centrifugal compressor. The centrifugal compressor comprises: a housing (10), provided with a mounting chamber (11), a thread section (12) being provided on a side wall of the mounting chamber (11); an adjusting piece (20), mounted in the mounting chamber (11), the adjusting piece (20) being provided with threads adapting to the thread section (12); a driving piece (30), mounted in the mounting chamber (11) and configured to drive the adjusting piece (20) to move forwards or backwards along
(Continued)

the thread section (12); and an adjustable diffuser (40), fixedly connected to the adjusting piece (20). The invention also discloses a centrifugal water chilling unit having the centrifugal compressor. The centrifugal compressor and the centrifugal water chilling unit can solve the problem that the adjustable diffuser easily inclines and is stuck, thereby greatly improving the reliability of the centrifugal compressor.

9 Claims, 2 Drawing Sheets

(52) U.S. Cl.
CPC ..... *F04D 29/4213* (2013.01); *F04D 29/464* (2013.01); *F05D 2250/51* (2013.01); *F05D 2250/52* (2013.01)

(58) Field of Classification Search
CPC .. F04D 29/466; F04D 29/468; F05D 2250/51; F05D 2250/52
See application file for complete search history.

(56) References Cited

U.S. PATENT DOCUMENTS 4,257,733 A * 3/1981 Bandukwalla ..... F04D 29/464 415/13
4,403,914 A * 9/1983 Rogo ..... F01D 17/143 415/150
4,898,523 A * 2/1990 Harwath ..... F04C 15/0076 403/326
4,932,835 A * 6/1990 Sorokes ..... F04D 29/462 415/150
4,969,798 A * 11/1990 Sakai ..... F04D 27/0246 415/150
5,924,847 A * 7/1999 Scaringe ..... F04D 25/06 417/42
6,039,534 A * 3/2000 Stoner ..... F01D 17/162 415/150
6,129,511 A * 10/2000 Salvage ..... F01D 17/02 415/1
6,139,262 A * 10/2000 Ravidranath ..... F04D 29/464 415/126
2004/0109757 A1 6/2004 Nenstiel

FOREIGN PATENT DOCUMENTS

CN 201358928 Y 12/2009
CN 201953718 U 8/2011
CN 203532279 U 4/2014
EP 2626573 A1 8/2013
GB 285815 A 5/1928
JP S52-158907 A 12/1977
JP S57-173599 A 10/1982
JP 2008111369 A 5/2008
JP 2008144615 A 6/2008
JP 2013174247 A 9/2013
KR 20120063089 A 6/2012
KR 10-1176312 B1 8/2012

OTHER PUBLICATIONS

European Patent Office, patent search report dated Jun. 28, 2017 regarding the counterpart European patent application of the present application.
Japan Patent Office, Office action dated Jun. 13, 2017 regarding the counterpart Japan patent application of the present application.
China Patent Office, Office action dated Jun. 23, 2016 regarding the counterpart China patent application of the present application.

* cited by examiner

CENTRIFUGAL COMPRESSOR AND CENTRIFUGAL WATER CHILLING UNIT

TECHNICAL FIELD OF THE INVENTION

The invention relates to the technical field of compressors, and in particular to a centrifugal compressor and a centrifugal water chilling unit.

BACKGROUND OF THE INVENTION

When a conventional centrifugal compressor is started, it is often necessary to totally close guide blades so as to prevent a starting current from being over-high. Meanwhile, a flow channel of an impeller outlet diffuser is narrowed. As a motor runs gradually and steadily, the guide blades are opened step by step, and it is necessary to slowly increase the width of the flow channel of the impeller outlet diffuser to a designed width.

In order to achieve a structural mode of this variable-section diffuser, several materials such as cams, guide rods and springs are often added to a position underneath a guide blade shaft, such that the guide blade shaft is pushed by the cams and the guide rods in an operating process, and the guide rods move backwards as needed under the counter-action of the springs. Thus, an adjustable diffuser can be driven to move forwards and backwards.

However, since synchronization of the cams driven by the guide blade shaft in the operating process cannot be completely guaranteed, synchronization of contact positions of the cams and the guide rods cannot be completely guaranteed, so that error accumulation is caused, it is quite easily caused that some of the guide rods are moving while the rest do not start to move yet, and the problem that the adjustable diffuser easily inclines and is stuck is caused by such non-synchronization, thereby causing serious consequences of cooling quantity insufficiency, surging or even damage to core parts such as an impeller and a bearing, and seriously threatening the reliability of the centrifugal compressor.

SUMMARY OF THE INVENTION

The invention aims to provide a centrifugal compressor and a centrifugal water chilling unit, which are intended to solve the problem in the conventional art that an adjustable diffuser of the centrifugal compressor easily inclines and is stuck.

In order to solve the technical problem, according to one aspect of the invention, a centrifugal compressor is provided, which may comprise: a housing, provided with a mounting chamber, a thread section being provided on a side wall of the mounting chamber; an adjusting piece, mounted in the mounting chamber, the adjusting piece being provided with threads adapting to the thread section; a driving piece, mounted in the mounting chamber and configured to drive the adjusting piece to move forwards or backwards along the thread section; and an adjustable diffuser, fixedly connected to the adjusting piece.

Furthermore, the mounting chamber may comprise an annular mounting slot, the driving piece may be a driving ring mounted in the annular mounting slot, the adjusting piece may be an adjustment ring mounted in the annular mounting slot, and the driving ring may rotate in the annular mounting slot to drive the adjustment ring to move forwards or backwards.

Furthermore, the threads may be provided on an outer circumferential wall of the adjustment ring, and the thread section may be provided on a slot wall, opposite to the outer circumferential wall of the adjustment ring, of the annular mounting slot.

Furthermore, the driving piece may be in driving connection with the adjusting piece via a connecting rod.

Furthermore, a first mounting hole may be provided in a first end surface of the driving piece, a second mounting hole opposite to the first mounting hole may be provided in an end surface, opposite to the first end surface, of the adjusting piece, and two ends of the connecting rod may be provided in the corresponding first mounting hole and the corresponding second mounting hole respectively.

Furthermore, there may be 6 to 10 connecting rods which are uniformly arranged in a circumferential direction of the driving piece.

Furthermore, the connecting rod may be pin, and the diameter of the connecting rod may be $\phi 10$ to $\phi 15$.

Furthermore, the centrifugal compressor may further comprise a blade assembly, the driving piece driving the blade assembly to rotate.

Furthermore, the blade assembly may comprise: a blade, located at an air inlet of the centrifugal compressor; a blade shaft, a first end of the blade shaft being fixedly connected to the blade, and an end, away from the blade, of the blade shaft penetrating into the mounting chamber; a limiting nut, detachably provided at the end, away from the blade, of the blade shaft; and an execution piece, fixed to the blade shaft, the execution piece being in driving connection with the driving piece.

Furthermore, the execution piece may be a bevel gear, and a rack matched with the bevel gear may be provided on an end surface, close to the bevel gear, of the driving piece.

Furthermore, the bevel gear may be fixed to the blade shaft via a key joint.

Furthermore, a mounting groove may be provided on a inner side of the adjusting piece, and a end, away from the blade, of the blade shaft may be located in the mounting groove.

According to another aspect of the invention, a centrifugal water chilling unit is provided, which may comprise a centrifugal compressor. The centrifugal compressor may be an above-mentioned centrifugal compressor.

By means of the technical solutions of the invention, the centrifugal compressor comprises the housing, the adjusting piece, the driving piece and the adjustable diffuser, wherein the housing is provided with the mounting chamber, and the thread section is provided on the side wall of the mounting chamber; the adjusting piece is mounted in the mounting chamber and is provided with the threads adapting to the thread section; the driving piece is mounted in the mounting chamber and drives the adjusting piece to move forwards or backwards along the thread section; and the adjustable diffuser is fixedly connected to the adjusting piece. According to the invention, when the driving piece drives the adjusting piece to move forwards or backwards along the thread section, the adjustable diffuser fixedly provided on the adjusting piece can move forwards or backwards in synchronization with the adjusting piece due to a thread fit connection between the adjusting piece and the mounting chamber. Consequently, the adjustable diffuser eliminates the phenomenon of asynchronous movement, and the problem that the adjustable diffuser easily inclines and is stuck is solved, thereby greatly improving the reliability of the centrifugal compressor.

BRIEF DESCRIPTION OF THE DRAWINGS

The drawings forming a part of the invention are intended to provide further understanding of the invention. The schematic embodiments and descriptions of the invention are intended to explain the invention, and do not form improper limits to the invention. In the drawings.

Drawing mark descriptions: 10, housing; 11, mounting chamber; 12, thread section; 13, annular mounting slot; 14, first half housing; 15, second half housing; 20, adjusting piece; 21, second mounting hole; 22, mounting groove; 30, driving piece; 31, first mounting hole; 32, rack; 40, adjustable diffuser; 50, connecting rod; 60, blade assembly; 61, blade; 62, blade shaft; 63, limiting nut; 64, execution piece; 70, impeller air outlet; and 80, air inlet.

DETAILED DESCRIPTION OF THE EMBODIMENTS

The embodiments of the invention are described below in detail with reference to the drawings. However, the invention can be implemented in multiple different modes limited and covered by claims.

Figure 1:
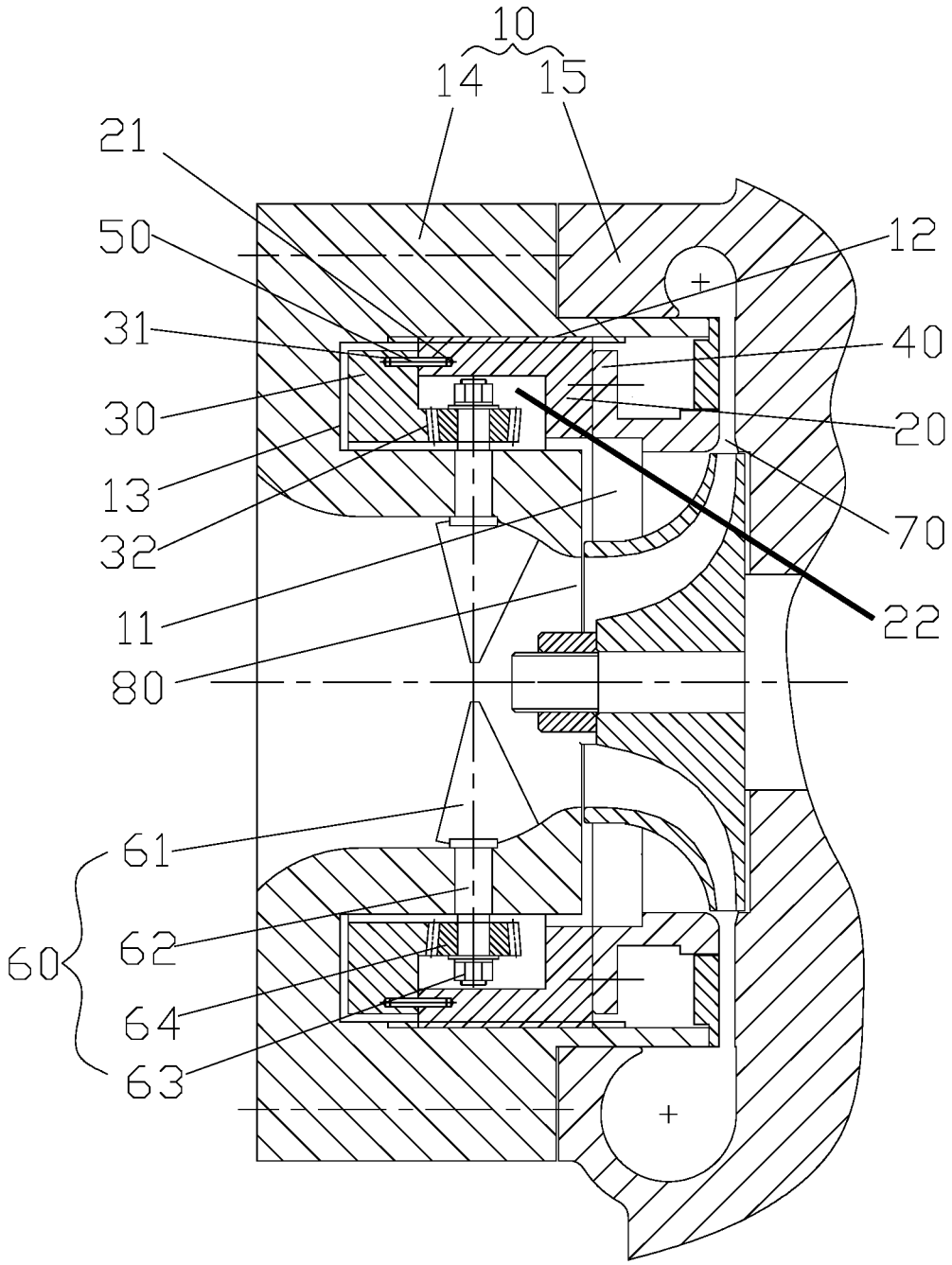
FIG. 1 schematically shows a section view of a totally-opened blade of a centrifugal compressor according to the invention.
Figure 2:
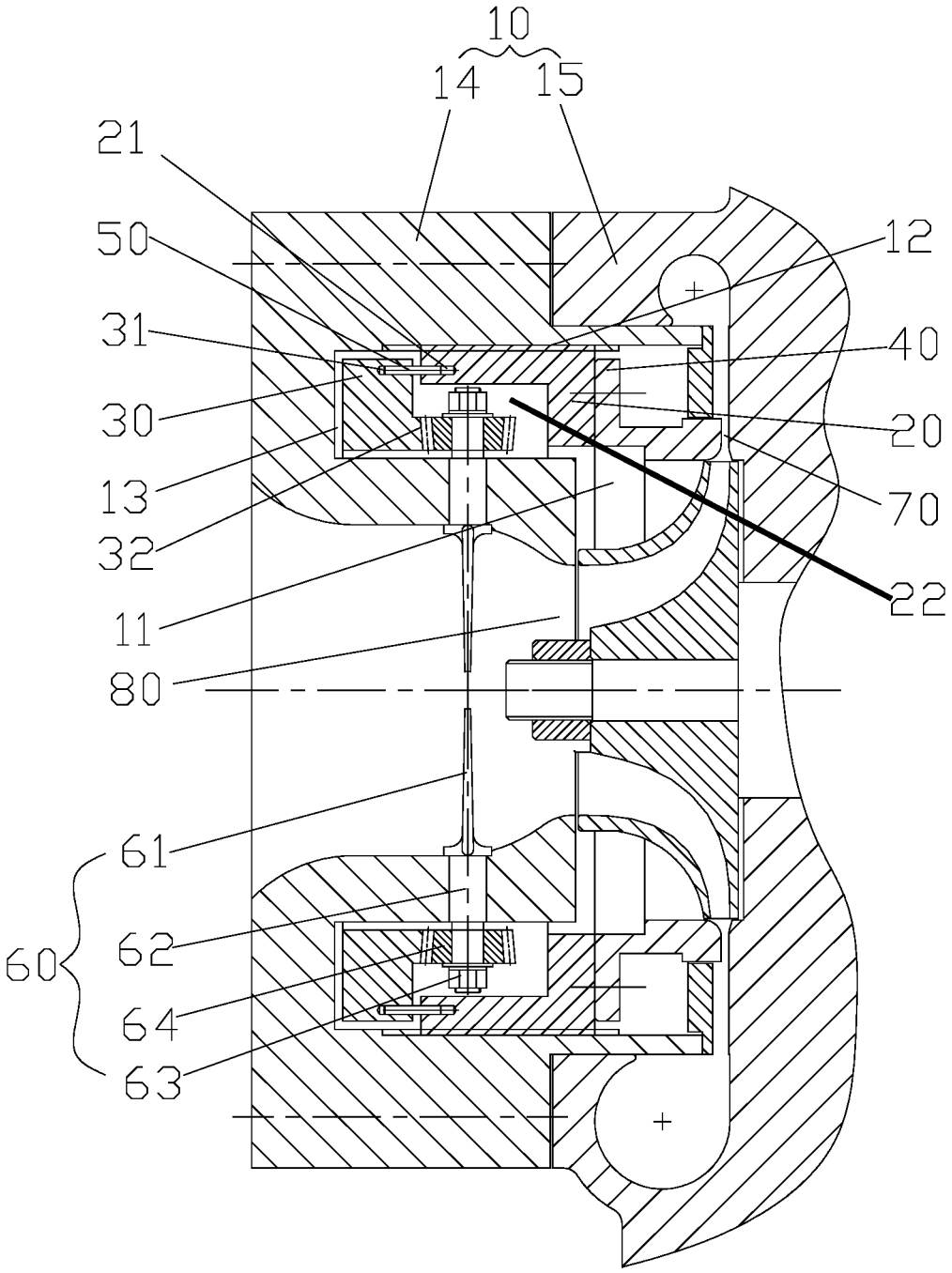
FIG. 2 schematically shows a section view of a totally-closed blade of a centrifugal compressor according to the invention.

As shown in FIG. 1 and FIG. 2, according to an embodiment of the invention, a centrifugal compressor comprises a housing 10, an adjusting piece 20, a driving piece 30 and an adjustable diffuser 40, wherein the housing 10 is provided with a mounting chamber 11, and a thread section 12 is provided on a side wall of the mounting chamber 11; the adjusting piece 20 is mounted in the mounting chamber 11, and the adjusting piece 20 is provided with threads adapting to the thread section 12; the driving piece 30 is mounted in the mounting chamber and drives the adjusting piece 20 to move forwards or backwards along the thread section 12; and the adjustable diffuser 40 is fixedly connected to the adjusting piece 20. In the embodiment, when the driving piece 30 drives the adjusting piece 20 to move forwards or backwards along the thread section 12, the adjustable diffuser 40 fixedly provided on the adjusting piece 20 can move forwards or backwards in synchronization with the adjusting piece 20 due to a thread fit connection between the adjusting piece 20 and the mounting chamber 11. Consequently, the adjustable diffuser 40 eliminates the phenomenon of asynchronous movement, and the problem that the adjustable diffuser 40 easily inclines and is stuck is solved, thereby greatly improving the reliability of the centrifugal compressor.

In the embodiment, the housing 10 comprises two half housings namely a first half housing 14 and a second half housing 15, each of the two half housings being provided with an internal cavity. When the two half housings are connected in an alignment manner, the internal mounting chamber 11 is formed. By means of the two half housings, an internal structure is convenient to mount and dismount. Specifically speaking, the mounting chamber 11 is internally provided with an annular mounting slot 13 formed by the first half housing 14, and both the driving piece 30 and the adjusting piece 20 are mounted in the annular mounting slot 13; at this time, the driving piece 30 is set as a driving ring, and the adjusting piece 20 is set as an adjustment ring; and when the driving ring rotates in the annular mounting slot 13, the adjustment ring can be driven to move forwards or backwards along the thread section 12 in the mounting chamber 11. The driving ring in the embodiment is driven by an electronic electric actuator or a spherical coupling (unmarked in Figure).

Preferably, threads on the adjustment ring are provided on an outer circumferential wall of the adjustment ring, and the thread section 12 in thread fit with the adjustment ring is provided on a slot wall, opposite to the outer circumferential wall of the adjustment ring, of the annular mounting slot 13. In other embodiments, the threads on the adjustment ring can also be provided on an inner circumferential wall of the adjustment ring, and correspondingly, the thread section 12 is provided on the slot wall, opposite to the inner circumferential wall of the adjustment ring, of the annular mounting slot 13. It is only necessary to guarantee that the adjustment ring can be driven by the driving piece 30 to move forwards or backwards along the thread section 12 so as to adjust the width of an impeller air outlet 70.

Preferably, the driving piece 30 is in driving connection with the adjusting piece 20 via connecting rods 50. More preferably, first mounting holes 31 are provided in a first end surface of the driving piece 30, second mounting holes 21 opposite to the first mounting holes 31 are provided in an end surface, opposite to the first end surface of the driving piece 30, of the adjusting piece 20, two ends of each connecting rod 50 are provided in the corresponding first mounting hole 31 and the corresponding second mounting hole 21 respectively, and the inner diameter of each first mounting hole 31 and/or the inner diameter of each second mounting hole 21 are greater than the outer diameter of the corresponding connecting rod 50. When the driving piece 30 rotates forwardly and reversely in the annular mounting slot 13, the adjustment ring is driven to move forwards or backwards along the thread section 12 under the action of the connecting rods 50 so as to drive the adjustable diffuser 40 to move forwards or backwards, thereby solving the problem in the conventional art that the adjustable diffuser 40 easily inclines and is stuck due to asynchronous movement of all parts of the adjustable diffuser 40.

In the embodiment, the number of the connecting rods 50 between the driving piece 30 and the adjusting piece 20 should not be too large, and if there are too many connecting rods, the assembly difficulty will be increased. Since a larger static friction force will be generated between the adjusting piece 20 and the housing 10 in the beginning of rotation, there cannot be too few connecting rods 50 here. The number of pins is controlled to be 6-10 suitably, 8 pins being optimal. The pins are uniformly arranged in a circumferential direction of the driving piece 30, and can well drive the adjusting piece 20 to move forwards or backwards. Preferably, the connecting rods 50 are the pins, thereby being simple in structure and easy to implement. Moreover, the diameter of each pin is $\phi 10$ to $\phi 15$, for example, $\phi 12$. The structural strength of each pin can be guaranteed, and parts can be prevented from being over-sized and over-weighted.

Preferably, the centrifugal compressor in the embodiment further comprises a blade assembly 60, and the rotation of the blade assembly 60 is also driven by the driving piece 30. Specifically speaking, the blade assembly 60 comprises a blade 61, a blade shaft 62, a limiting nut 63 and an execution piece 64, wherein the blade 61 is located at an air inlet 80 of the centrifugal compressor, and the quantity of a fluid entering the centrifugal compressor is controlled; a first end of the blade shaft 62 is fixedly connected to the blade 61, and an end, away from the blade 61, of the blade shaft 62 penetrates into the mounting chamber 11; the limiting nut 63 is detachably provided at the end, away from the blade 61, of the blade shaft 62, and an integrated structure formed by the blade shaft 62 and the blade 61 is fixed to the air inlet 80; and the execution piece 64 is fixed to the blade shaft 62 and is in driving connection with the driving piece 30, and when the driving piece 30 rotates in the annular mounting slot 13, the blade 61 is driven to rotate at the air inlet 80 so as to control the flow of the fluid at the air inlet 80.

Preferably, the execution piece 64 is a bevel gear, and a rack 32 matched with the bevel gear is provided on an end surface, close to the bevel gear, of the driving piece 30. When the driving piece 30 rotates, the rack 32 drives the bevel gear to rotate so as to drive the blade 61 to rotate.

Preferably, the bevel gear is fixed to the blade shaft 62 via a key joint (unmarked in Figure), and is locked in the annular mounting slot 13 by the limiting nut 63.

Preferably, a mounting groove 22 is provided on a inner side of the adjusting piece 20, and a end, away from the blade 61, of the blade shaft 62 is located in the mounting groove 22, so that the entire structure layout is compact, and the size of the entire centrifugal compressor is reduced. In other embodiments, the end, away from the blade 61, of the blade shaft 62 can also be provided on one side, opposite to the adjusting piece 20, of the driving piece 30. It is only necessary to guarantee that the blade assembly 60 and the adjusting piece 20 can be driven simultaneously during the rotation of the entire driving piece 30.

A working process of the centrifugal compressor in the invention is specifically described with reference to the above-mentioned embodiments.

The driving ring is driven by the electric actuator or the spherical coupling, and the driving ring rotates in the annular mounting slot 13 to drive the adjustment ring to move forwards or backwards along the thread section 12, so that the adjustable diffuser 40 fixedly provided on the adjustment ring is driven to move forwards or backwards, and the blade assembly 60 is driven to rotate, thereby realizing an airflow situation of the impeller air outlet 70 of the centrifugal compressor by means of the movement of the adjustable diffuser 40, and realizing control over the flow of an airflow at the air let 80 of the centrifugal compressor by means of the rotation of the blade 61.

According to another embodiment of the invention, a centrifugal water chilling unit is provided, which comprises a centrifugal compressor. The centrifugal compressor is an above-mentioned centrifugal compressor.

From the above descriptions, it can be seen that the embodiments of the invention achieve the technical effects as follow.

The driving ring and the adjustment ring are provided in the annular mounting slot, and can be circumferentially located via the pins. Then, the adjustable diffuser is fixed to the adjustment ring, and the threads are provided on the outer circumferential wall of the adjustment ring and are matched with the thread section in the annular mounting slot, so that end surfaces of the driving ring and the adjustment ring are separable, and connection drive is realized via the pins. When the electronic electric actuator drives the driving ring to rotate, the driving ring drives the blade to rotate via the bevel gear, and drives the adjustable diffuser to stretch via the adjustment ring, so that the entire synchronous movement of the adjustable diffuser can be realized, a potential safety hazard that the adjustable diffuser is stuck due to non-synchronization is eliminated, and the reliability of the compressor is greatly improved.

The above is only the preferred embodiments of the invention, and is not intended to limit the invention. There can be various modifications and variations in the invention for those skilled in the art. Any modifications, equivalent replacements, improvements and the like within the spirit and principle of the invention shall fall within the protection scope of the invention.

The invention claimed is:

1. A centrifugal compressor, comprising:

a housing (10) provided with a mounting chamber (11), a thread section (12) being provided on a side wall of the mounting chamber (11);

an adjusting piece (20) mounted in the mounting chamber (11), the adjusting piece (20) being provided with threads adapting to the thread section (12);

a driving piece (30) mounted in the mounting chamber (11) and configured to drive the adjusting piece (20) to move forwards or backwards along the thread section (12);

an adjustable diffuser (40) fixedly connected to the adjusting piece (20), wherein the driving piece (30) is in driving connection with the adjusting piece (20) via a connecting rod (50), wherein a first mounting hole (31) is provided in a first end surface of the driving piece (30), a second mounting hole (21) opposite to the first mounting hole (31) is provided in a second end surface, opposite to the first end surface, of the adjusting piece (20), and two ends of the connecting rod (50) is provided in the corresponding first mounting hole (31) and the corresponding second mounting hole (21) respectively; and a blade assembly (60), the driving piece (30) driving the blade assembly (60) to rotate, wherein the blade assembly (60) comprises:

a blade (61), located at an air inlet (80) of the centrifugal compressor;

a blade shaft (62), a first end of the blade shaft (62) being fixedly connected to the blade (61), and an end, away from the blade (61), of the blade shaft (62) penetrating into the mounting chamber (11);

a limiting nut (63), detachably provided at the end, away from the blade (61), of the blade shaft (62); and an execution piece (64), fixed to the blade shaft (62), the execution piece (64) being in driving connection with the driving piece (30).

2. The centrifugal compressor according to claim 1, wherein the mounting chamber (11) comprises an annular mounting slot (13), the driving piece (30) is a driving ring mounted in the annular mounting slot (13), the adjusting piece (20) is an adjustment ring mounted in the annular mounting slot (13), and the driving ring rotates in the annular mounting slot (13) to drive the adjustment ring to move forwards or backwards.

3. The centrifugal compressor according to claim 2, wherein the threads are provided on an outer circumferential wall of the adjustment ring, and the thread section (12) is provided on a slot wall, opposite to the outer circumferential wall of the adjustment ring, of the annular mounting slot (13).

4. The centrifugal compressor according to claim 1, wherein there are 6 to 10 connecting rods (50) which are uniformly arranged in a circumferential direction of the driving piece (30).

5. The centrifugal compressor according to claim 4, wherein the connecting rod (50) is a pin.

6. The centrifugal compressor according to claim 1, wherein the connecting rod (50) is a pin.

7. The centrifugal compressor according to claim 1, wherein the execution piece (64) is a bevel gear, and a rack (32) matched with the bevel gear is provided on an end surface, close to the bevel gear, of the driving piece (30).

8. The centrifugal compressor according to claim 1, wherein a mounting groove (22) is provided on an inner side of the adjusting piece (20), and an end, away from the blade (61), of the blade shaft (62) is located in the mounting groove (22).

9. A centrifugal water chilling unit, comprising a centrifugal compressor, the centrifugal compressor being a centrifugal compressor according to claim 1.

* * * * *